US006155671A

United States Patent [19]

Fukumoto et al.

[11] Patent Number: 6,155,671

[45] Date of Patent: Dec. 5, 2000

[54] LIQUID EJECTOR WHICH USES A HIGH-ORDER ULTRASONIC WAVE TO EJECT INK DROPLETS AND PRINTING APPARATUS USING SAME

[75] Inventors: Hiroshi Fukumoto; Jyunichi Aizawa; Hirohumi Matsuo; Hiromu Narumiya; Kunihiko Nakagawa, all of Tokyo, Japan

[73] Assignee: Mitsubishi Denki Kabushiki Kaisha, Tokyo, Japan

[21] Appl. No.: 08/958,981

[22] Filed: Oct. 28, 1997

[30] Foreign Application Priority Data

Oct. 30, 1996 [JP] Japan ..... 8-288594

[51] Int. Cl.[7] ..... B41J 2/135

[52] U.S. Cl. ..... 347/46

[58] Field of Search ..... 347/46, 47, 10, 347/11

[56] References Cited

U.S. PATENT DOCUMENTS

| | | | |
|---|---|---|---|
| 4,380,547 | 4/1983 | Materne | 514/341 |
| 5,808,636 | 9/1998 | Stearns | 347/46 |
| 5,821,958 | 10/1998 | Lim | 347/46 |
| 5,912,679 | 6/1999 | Takayama et al. | 347/46 X |
| 5,917,521 | 6/1999 | Haga et al. | 347/46 |
| 5,953,027 | 9/1999 | Suwabe et al. | 347/46 |

FOREIGN PATENT DOCUMENTS

| | | | |
|---|---|---|---|
| 0575204A2 | 12/1993 | European Pat. Off. . | |
| 0783965A2 | 7/1997 | European Pat. Off. . | |
| 63-166545 | 7/1988 | Japan . | |
| 1-101157 | 4/1989 | Japan | 347/46 |
| 2-55139 | 2/1990 | Japan | 347/46 |
| 2-303849 | 12/1990 | Japan . | |
| 4-294147 | 10/1992 | Japan | 347/46 |
| 1645826 | 4/1991 | U.S.S.R. | 347/46 |
| 9301404A | 1/1993 | WIPO . | |

OTHER PUBLICATIONS

S.A. Elrod et al, Nozzleless Droplet Formation With Focused Acoustic Beams, Xerox Palo Alto Research Center, 333 Coyote Hill Rd. Palo Alto, California 94304, (Received Nov. 7, 1988; accepted for publication Jan. 4, 1989), pp. 3441–3447.

Abstract of Japanese patent Laid–Open Gazette No. 2–303849: "Ink Jet Head".

K.A. Krause, "Focusing Ink Jet Head", *IBM Technical Disclosure Bulletin*, Vol. 16, No. 4, 1973, p. 1168.

*Primary Examiner*—John Barlow
*Assistant Examiner*—C. Dickens

[57] ABSTRACT

The particle diameter of droplets is controlled without improvements on a nozzle plate. An ultrasonic wave causes a radiation pressure to be intermittently applied to an opening in a cycle having a period shorter than the fundamental vibration period of a liquid surface in the opening. A high-order standing wave is then generated at the liquid surface in the opening to cause a plurality of droplets to be emitted simultaneously. Since the plurality of droplets are simultaneously emitted from a plurality of mounds of the high-order standing wave, the droplets have a diameter smaller than the diameter of the opening and are emitted vertically upwardly. The diameter of the droplets is controlled by the order of the high-order standing wave to be generated. The order of the standing wave is increased by shortening the period for which the radiation pressure is applied to the opening.

20 Claims, 11 Drawing Sheets

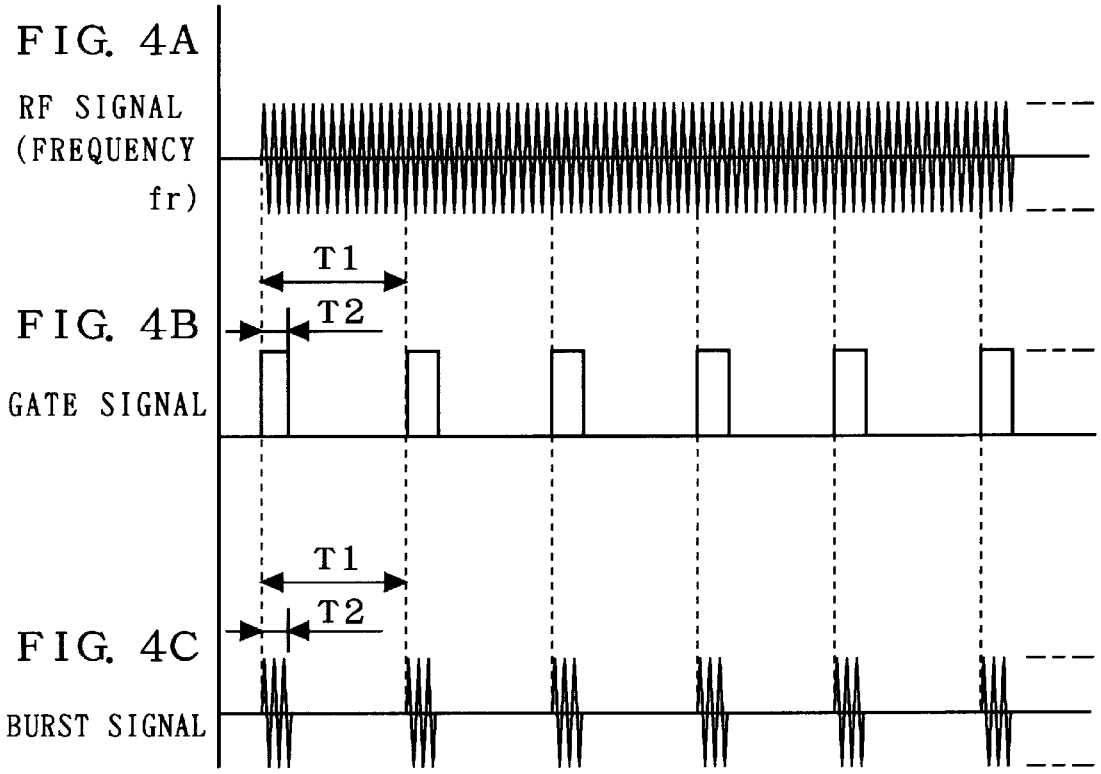
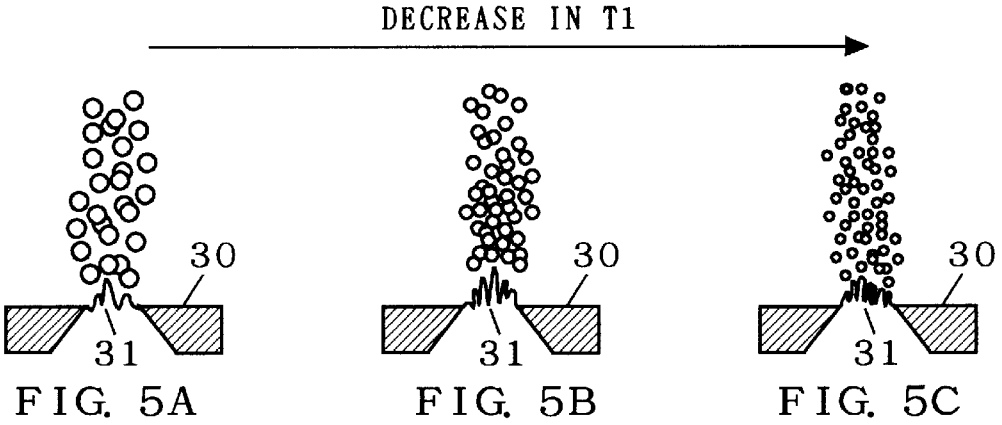
FIG. 5A FIG. 5B FIG. 5C

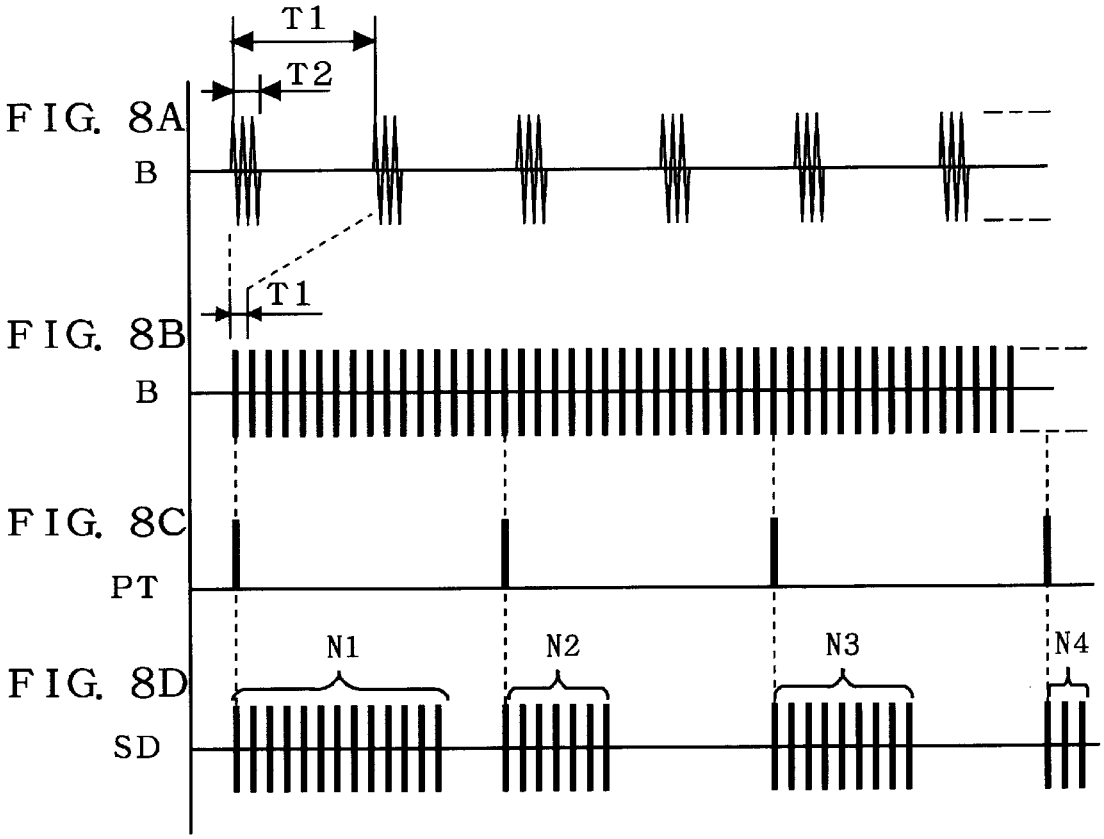
FIG. 9
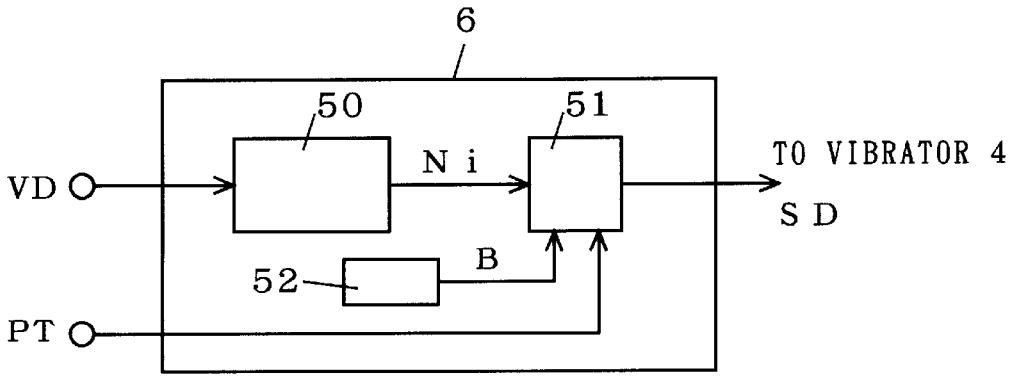

FIG. 14
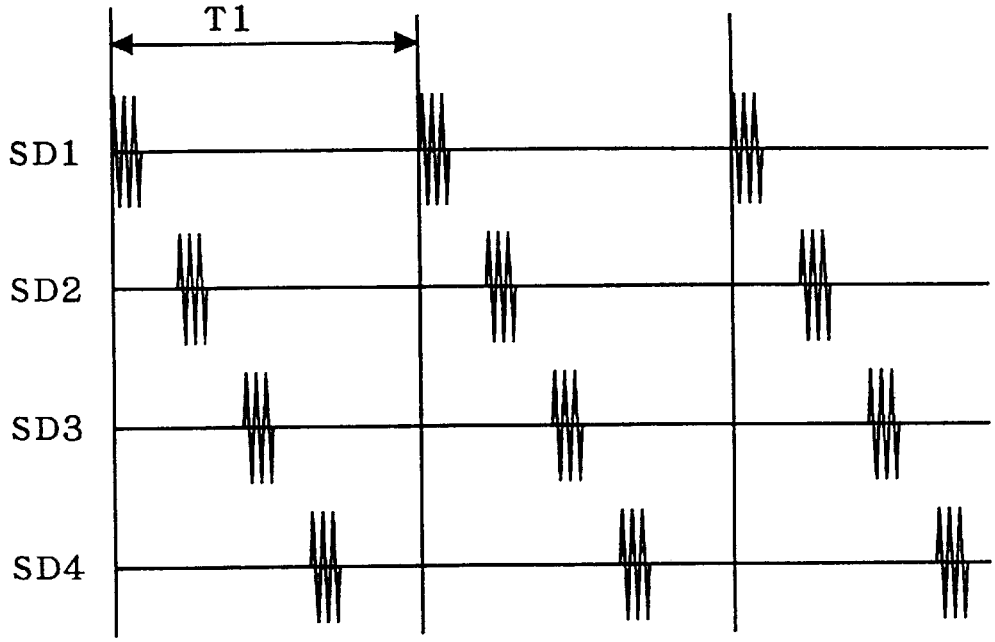
FIG. 15 "PRIOR ART"
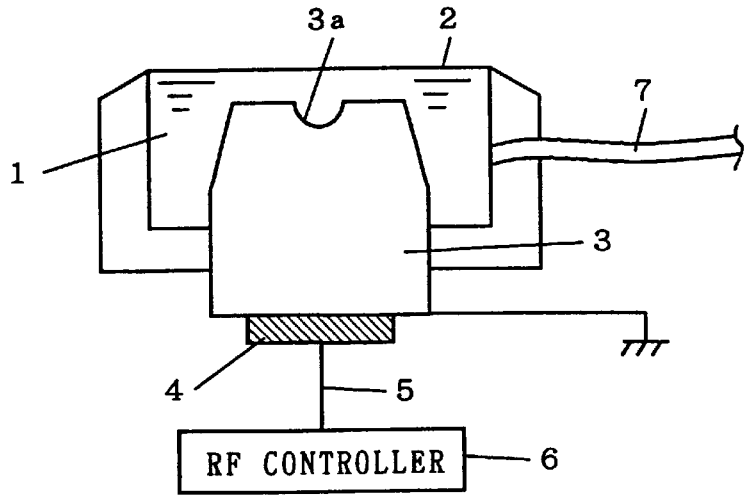

FIG. 16 "PRIOR ART"
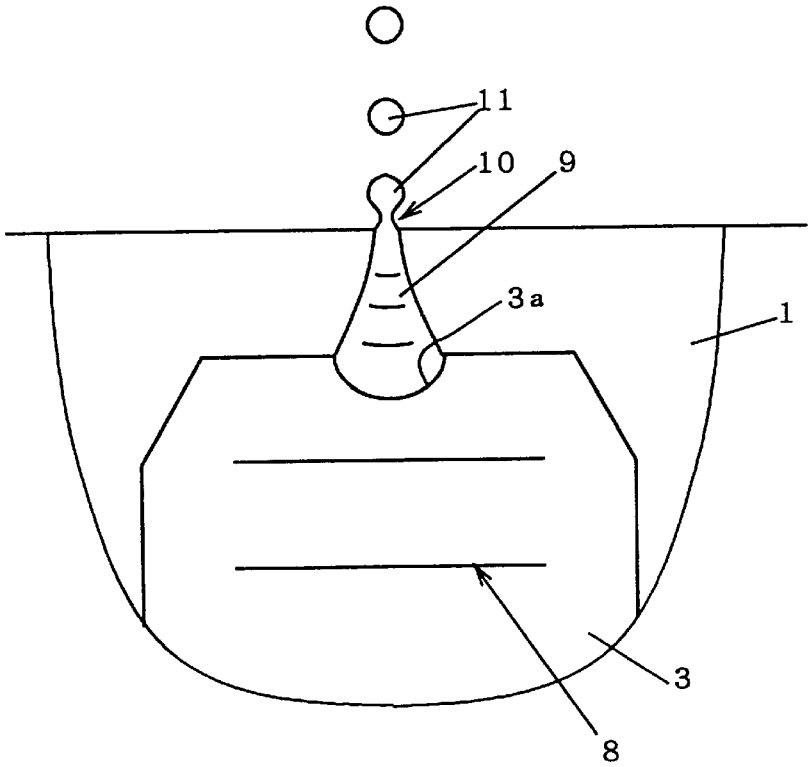
"PRIOR ART"
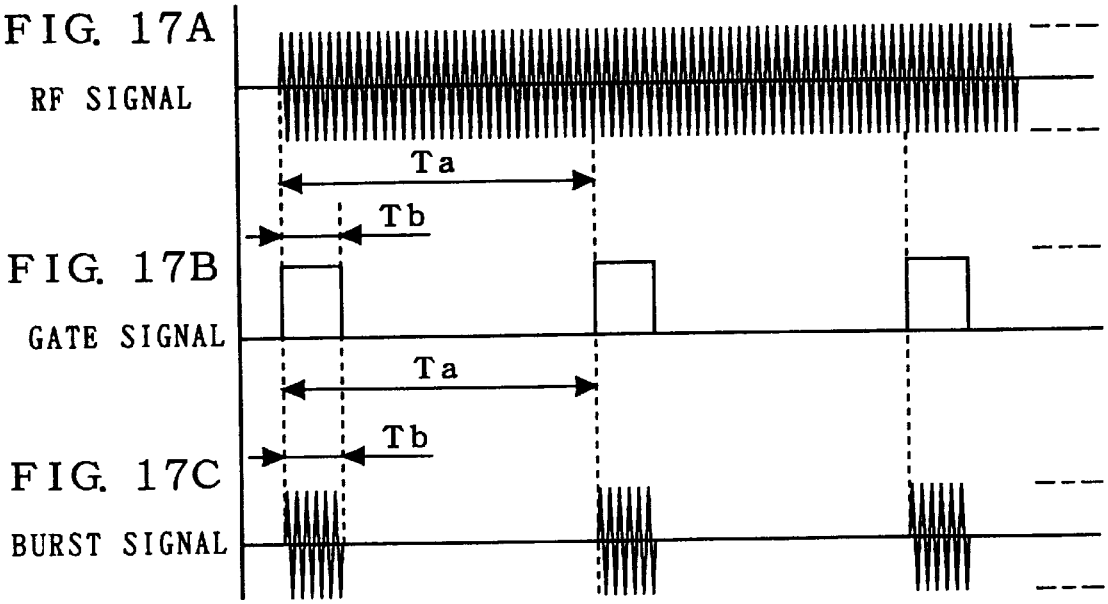

"PRIOR ART"
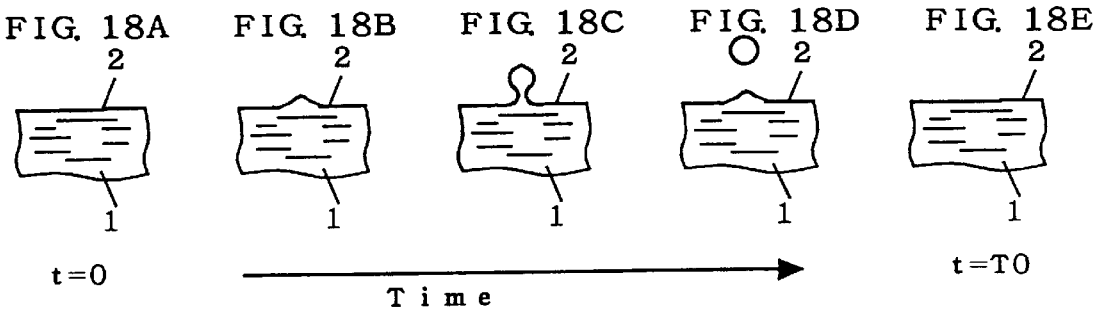
FIG. 19 "PRIOR ART"
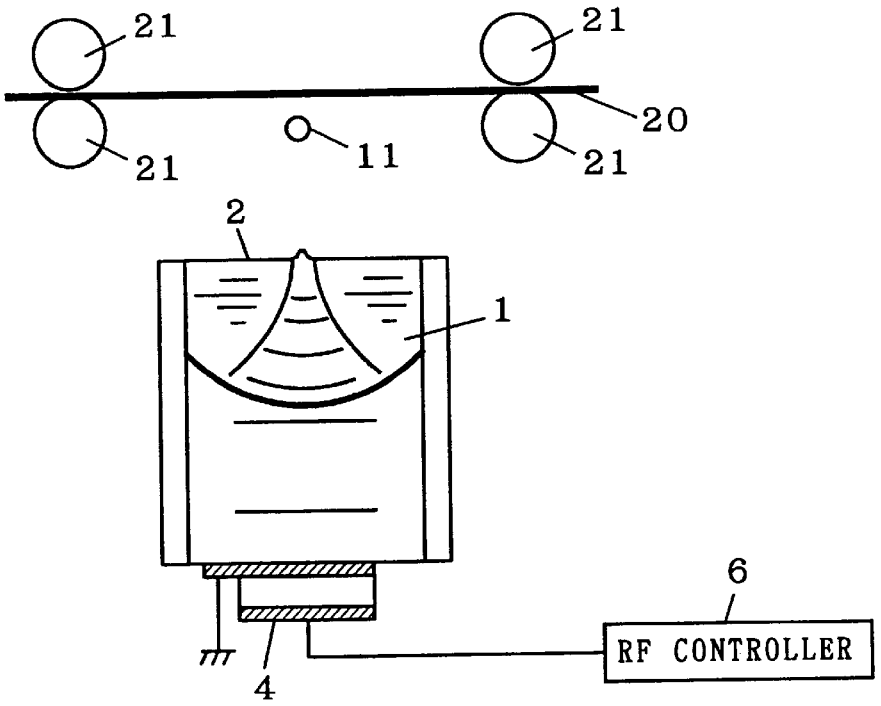

FIG. 20 "PRIOR ART"
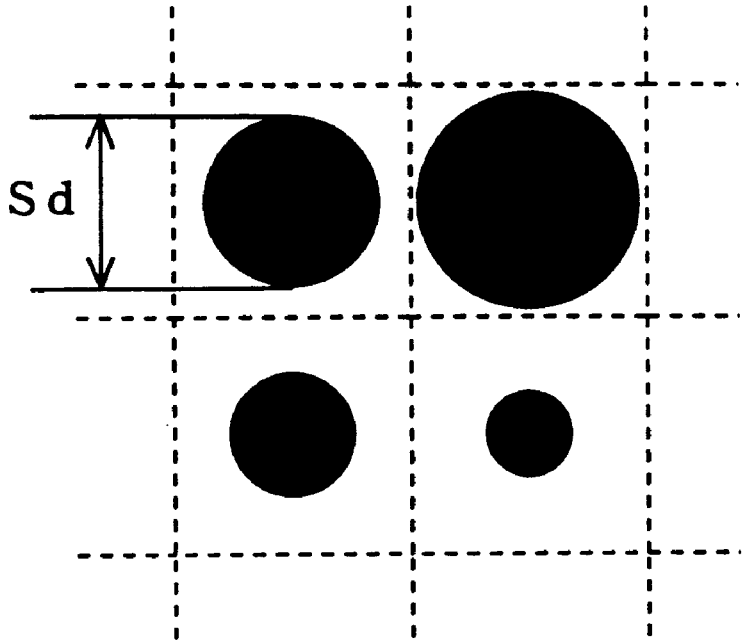

LIQUID EJECTOR WHICH USES A HIGH-ORDER ULTRASONIC WAVE TO EJECT INK DROPLETS AND PRINTING APPARATUS USING SAME

BACKGROUND OF THE INVENTION

1. Field of the Invention

The present invention relates to a liquid ejector which uses an ultrasonic wave to eject droplets of ink from an ink liquid surface, and a printing apparatus such as an ink jet printer which employs such a liquid ejector to print characters and images on recording paper.

2. Description of the Background Art

In the field of printing apparatuses, an ink jet head which uses an ultrasonic wave to eject ink from a nozzle has conventionally been known as a liquid ejector. For example, K. A. Krause, "Focusing Ink Jet Head", IBM Technical Disclosure Bulletin, Vol. 16, No. 4, 1973, p. 1168 discloses an ink jet head which emits a jet of ink from a nozzle provided adjacent the focal point of the ultrasonic wave. This ink jet head is designed such that the ultrasonic wave emitted from a piezoelectric vibrator mounted on the rear surface of a member having a concave surface which contacts ink is refracted at the concave surface to propagate in the ink while being focused.

A liquid drop emitter which employs a curved crystal having a concave surface to focus an ultrasonic beam from the liquid ejector is disclosed in U.S. Pat. No. 4,308,547. A driving method for emitting droplets one by one is applied to the liquid drop emitter. The liquid drop emitter is designed to intermittently apply a drive signal at the resonant frequency of the crystal so that the number of drive signals intermittently applied equals the number of emitted droplets.

FIG. 15 is a cross-sectional view of a liquid drop emitter disclosed in Japanese Patent Application Laid-Open No. 63-166545 (1988) which uses the liquid drop emitting technique disclosed in the above referenced U.S. patent. In FIG. 15, the reference numeral 1 designates ink; 2 designates a liquid surface of the ink 1; 3 designates a substrate mounted in an ink reservoir filled with the ink 1 for directly transmitting an ultrasonic wave into the ink 1; 4 designates a vibrator mounted on the bottom surface of the substrate 3; 5 designates a lead for electrically sending a drive signal to the vibrator 4; 6 designates an RF controller for outputting the drive signal to be sent through the lead 5; and 7 designates a tube for supplying the ink 1 to retain the ink liquid surface 2 in position. The substrate 3 includes an acoustic lens 3*a* having a curvature such that the focal point of the ultrasonic wave emitted from the substrate 3 is adjusted to be at the ink liquid surface 2. FIG. 16 is a schematic view of the liquid drop emitter of FIG. 15 which shows that the ultrasonic wave is focused by the acoustic lens 3*a*. Like reference numerals are used in FIG. 16 to designate elements identical with or corresponding to those of FIG. 15.

A high-frequency drive signal (referred to hereinafter as a burst signal) which is AM modulated by a pulse signal is applied from the RF controller 6 through the lead 5 to the vibrator 4 of FIG. 15. The vibrator 4 vibrates in the thickness direction at the high frequency only in the presence of the high frequency in the burst signal, to generate an ultrasonic wave 8 and transmit the ultrasonic wave 8 to the substrate 3. The ultrasonic wave 8 transmitted to the substrate 3 propagates in the substrate 3, and is partially refracted by the acoustic lens 3*a* to become an ultrasonic beam 9 propagating in the ink 1. The ultrasonic beam 9 is focused on the ink liquid surface 2, and ink droplets 11 are emitted from a focal point 10 at which the pressure is increased by the ultrasonic beam 9.

Controlled emission of the ink droplets 11 one by one is achieved by applying a high-frequency signal to the vibrator 4 for a short time period each time the ink droplet emission is required. FIGS. 17A through 17C are timing, charts illustrating the application of the high-frequency signal. The high-frequency signal is a radio-frequency signal (RF signal) at the resonant frequency of the vibrator 4 and is shown in FIG. 17A. For the application of the high-frequency signal for a predetermined time period for each requirement of the droplet emission, the RF signal is AM modulated by a gate signal (FIG. 17B) which is a pulse signal having a period Ta and a pulse width Tb to produce the burst signal shown in FIG. 17C. The application of the burst signal to the vibrator 4 causes an ultrasonic radiation pressure to act like pulses upon the focal point 10 to allow the one-by-one droplet emission.

FIGS. 18A through 18E are cross-sectional views of the ink liquid surface 2 at different times for illustration of the formation of a droplet. FIG. 18A shows the initial state wherein the ink liquid surface 2 of the ink 1 is flat since no ultrasonic radiation pressure acts upon the ink liquid surface 2. As the ultrasonic radiation pressure acts upon the ink liquid surface 2, the ink surface 2 is raised into a mound as shown in FIG. 18B. Thereafter, part of the mound starts separating in the vertical direction as shown in FIG. 18C, resulting in the separation of a droplet as shown in FIG. 18D. Then, the ink liquid surface 2 returns to its initial state wherein it has no mound but is flat because of its surface tension as shown in FIG. 18E. The time T0 required for a series of operations shown in FIGS. 18A through 18E is determined by the surface tension and density of the liquid (ink 1), the diameter of the focal spot, and the like. Thus, the print head is designed so that the period Ta of the pulse signal is greater than the time T0 for the one-by-one droplet emission. The details of the above described principle is described in S. A. Elrod et al., "Nozzleless droplet formation with focused acoustic beams", J. Appl. Phys. 65(9), May 1, 1989.

A method of varying the size of droplets by modulating the RF signal is also disclosed in Japanese Patent Application Laid-Open No. 63-166545. The method mainly includes processes for (1) varying the time duration (pulse width Tb) of the RF signal, (2) varying the amplitude of the RF signal, and (3) varying the frequency of the RF signal. The processes (1) to (3) are used alone or in combination to control the resolution of a printer.

FIG. 19 shows the printer disclosed in the above referenced patent application. In FIG. 19, the reference numeral 20 designates recording paper 20, and 21 designates rollers for feeding the recording paper 20. Like reference numerals are used in FIG. 19 to designate elements identical with or corresponding to those of FIG. 15. The printer of FIG. 19 comprises a print head similar to that shown in FIG. 16, and is adapted such that a plurality of fine ink droplets 11 of the same diameter emitted one by one from the print head are deposited on the recording paper 20 at the same position. A spot diameter Sd recorded on the recording paper 20 is varied as shown in FIG. 20 to allow the gray scale representation. A pixel is shown in FIG. 20 as a square region enclosed by dotted lines.

An ink jet head having a nozzle at an ink liquid surface and jetting droplets from an opening of the nozzle is disclosed in Japanese Patent Application Laid-Open No.

2-303849 (1990). The burst signal is used as the drive signal for driving the ink jet head. The amount of ink emitted from the ink jet head is controlled by varying the time duration for which the RF signal appears in the burst signal. The arrangement disclosed in this reference establishes a longer time duration of the RF signal for emission of a greater amount of ink. This causes the prolonged application of the ultrasonic radiation pressure to the nozzle opening. As a result, the droplets are considered to be emitted in the form of a spray from the nozzle opening.

The background art liquid ejector as shown in FIG. 15 which requires no nozzle is advantageous in eliminating the problem of clogging with ink. However, the liquid ejector of FIG. 15 must establish a high frequency of the RF signal for emission of fine droplets since a major factor which determines the droplet diameter depends on the focal spot diameter of the ultrasonic beam 9. As is observed by S. A. Elrod et al., the focal spot diameter of an acoustic lens having a focal length which is generally equal to the opening diameter is equal to the ultrasonic wavelength in the ink 1. For example, the velocity of sound in typical water-based ink is about 1500 m/s. Thus, in order to form droplets having a diameter of about 3 $\mu$m, the frequency of the RF signal must be 500 MHz to provide the wavelength of 3 $\mu$m. To handle such a high-frequency ultrasonic wave, a drive circuit is required to have a complicated structure and high-accuracy constituents, resulting in a very costly liquid ejector. Further, the requirement for the finishing accuracy of the surfaces of the acoustic lens 3*b* of the liquid ejector and the level accuracy of the ink liquid surface 2 to be equal to or greater than the accuracy of the wavelength makes it difficult to produce the droplet emitter.

Furthermore, the fine ink droplets are recorded by depositing one droplet over another to vary the spot diameter Sd on the recording paper 20, as shown in FIG. 20. Thus, there is a need to allow for time it takes to emit a required number of droplets for recording the spot of a maximum diameter, requiring much time for recording. Liquid ejectors other than that disclosed in Japanese Patent Application Laid-Open No. 63-166545 are believed to be controlled under stable conditions only within a limit which is twice the droplet diameter and to be difficult to represent the gray scale only by varying the droplet diameter.

The method of jetting the droplets from the nozzle opening of the liquid ejector as disclosed in Japanese Patent Application Laid-Open No. 2-303849 involves the need for a nozzle plate having a fine opening in order to reduce the size of the droplet diameter. Further, since the time duration of the RF signal is increased for emission of more ink, the droplets are emitted in the form of a spray from the nozzle opening. This causes random diameters of the droplets to present difficulty in forming a high-definition image.

SUMMARY OF THE INVENTION

According to a first aspect of the present invention, a liquid ejector comprises: a nozzle member having an opening at a liquid surface of a liquid to be emitted; and ultrasonic wave applying means for applying to the liquid surface in the opening an ultrasonic wave having an intensity varying in a predetermined period shorter than a fundamental vibration period of the liquid surface in the opening to generate a high-order standing wave at the liquid surface in the opening.

Preferably, according to a second aspect of the present invention, in the liquid ejector of the first aspect, the predetermined period is variable.

Preferably, according to the third aspect of the present invention, in the liquid ejector of the first or second aspect, a frequency of the intensity of the ultrasonic wave is varied by the ultrasonic wave applying means.

According to a fourth aspect of the present invention, a printing apparatus comprises: a liquid ejector including a nozzle member having an opening at a liquid surface of a liquid to be emitted, and ultrasonic wave applying means for applying to the liquid surface in the opening an ultrasonic wave having an intensity varying in a predetermined period shorter than a fundamental vibration period of the liquid surface in the opening to generate a high-order standing wave at the liquid surface in the opening; and paper feed means for feeding recording paper into opposed relation to the liquid ejector, wherein the liquid ejected from the liquid ejector is deposited on the recording paper fed by the paper feed means to make a print on the recording paper.

Preferably, according to a fifth aspect of the present invention, in the printing apparatus of the fourth aspect, the liquid ejector comprises a plurality of liquid ejectors, and the plurality of liquid ejectors differ from each other in timing of the variation in the intensity of the ultrasonic wave.

In the liquid ejector in accordance with the first aspect of the present invention, the application of the radiation pressure caused by the ultrasonic wave in the period shorter than the fundamental vibration period generates the high-order standing wave in the opening of the nozzle member to cause a plurality of droplets to be emitted simultaneously from a plurality of mounds of the standing wave. Thus, the liquid ejector requires no particularly expensive high-frequency signal source and no nozzle having a small opening diameter, and may emit the droplets having a small diameter at time intervals shorter than those of the background art. Further, since the liquid surface in the opening vibrates in the direction perpendicular to the liquid surface, the plurality of particles are emitted in the direction perpendicular to the liquid surface. This provides a beam of droplets having good directivity.

The liquid ejector in accordance with the second aspect of the present invention may vary the number of antinodes of the standing wave, allowing a wide-range variation in the diameter of the droplets to be emitted from the opening with a simple circuit without changing the nozzle member.

The liquid ejector in accordance with the third aspect of the present invention may vary the frequency with which the intensity of the ultrasonic wave varies, thereby varying the amount of ink to be emitted within the predetermined length of time.

The printing apparatus in accordance with the fourth aspect of the present invention requires no particularly expensive high-frequency signal source and no nozzle having a small opening diameter but may be less expensive. Additionally, the printing apparatus may emit the droplets having a small diameter to permit the ink to be difficult to blot on recording paper.

Furthermore, the good directivity of the plurality of droplets to be emitted provides a high resolution.

When the period of the variation in the intensity of the ultrasonic wave is variable, the printing apparatus may control the diameter of the droplets to be emitted to continuously control the recording density for each pixel on the recording paper with a simple circuit, achieving high-definition printing.

The printing apparatus also controls the recording shades in the same range in a stepped manner with a simple circuit arrangement, achieving high-definition printing.

The printing apparatus in accordance with the fifth aspect of the present invention controls the plurality of liquid ejectors so as not to be driven at the same time to suppress the maximum value of the instantaneous power consumption. This reduces crosstalk between the liquid ejectors without the addition of a new member.

These and other objects, features, aspects and advantages of the present invention will become more apparent from the following detailed description of the present invention when taken in conjunction with the accompanying drawings.

BRIEF DESCRIPTION OF THE DRAWINGS

FIG. 4A is a waveform chart of an RF signal;

FIG. 4B is a waveform chart of a gate signal;

FIG. 4C is a waveform chart of a burst signal;

FIGS. 5A through 5C are schematic illustrations adjacent an opening in the presence of a high-order standing wave;

FIGS. 8A through 8D are a timing chart showing the relationship between a drive signal and a burst signal;

FIG. 9 is a block diagram of an RF controller for generating the drive signal;

FIG. 14 is a timing chart showing the relationship between drive signals for driving the four heads of FIG. 12;

FIG. 15 is a cross-sectional view of a conventional liquid drop emitter;

FIG. 16 schematically illustrates ultrasonic waves focused by an acoustic lens of the liquid drop emitter of FIG. 15;

FIGS. 17A through 17C are a timing chart showing the relationship between an RF signal, a gate signal, and a burst signal;

FIGS. 18A through 18E are cross-sectional views of an ink liquid surface with time for illustration of the formation of a droplet;

FIG. 19 schematically illustrates a conventional print head which emits droplets one by one; and FIG. 20 is a plan view of spots recorded on recording paper using the conventional print head.

DESCRIPTION OF THE PREFERRED EMBODIMENTS

First Preferred Embodiment

Figure 1:
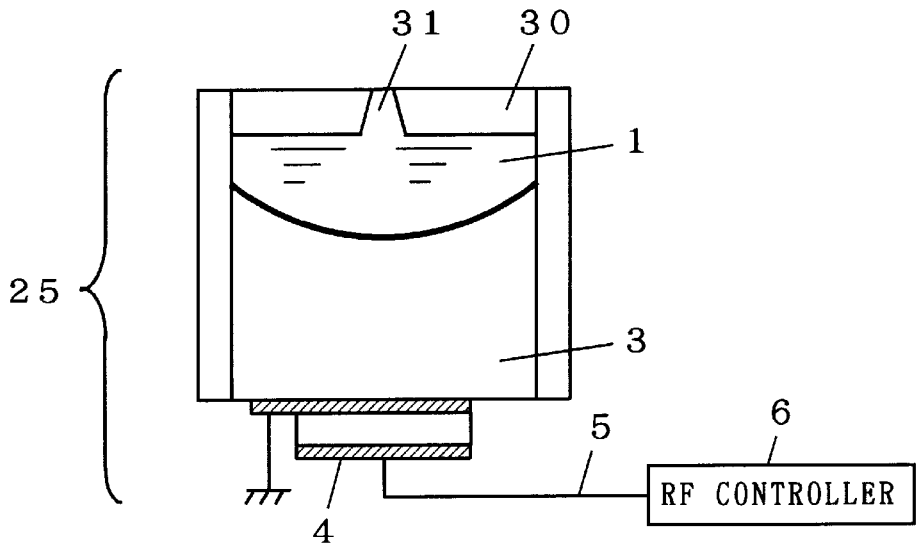
FIG. 1 is a schematic cross-sectional view of a head of a liquid ejector with a controller according to a first preferred embodiment of the present invention.

FIG. 1 is a schematic cross-sectional view of a head of a liquid ejector with a controller according to a first preferred embodiment of the present invention. In FIG. 1, the reference numeral 1 designates ink in an ink reservoir; 30 designates a nozzle plate having an opening 31 at the liquid surface of the ink 1; 3 designates a substrate provided on one surface of the ink reservoir in contact with the ink 1 for focusing an ultrasonic wave emitted from the inside thereof into the ink 1; 4 designates a vibrator mounted on the bottom surface of the substrate 3 for outputting the ultrasonic wave to the substrate 3; 5 designates a lead for transmitting a drive signal for vibrating the vibrator 4; and 6 designates an RF controller for generating the drive signal transmitted through the lead 5. A head 25 of the liquid ejector 25 comprises the nozzle plate 30, the substrate 3, and the vibrator 4.

Figure 2:
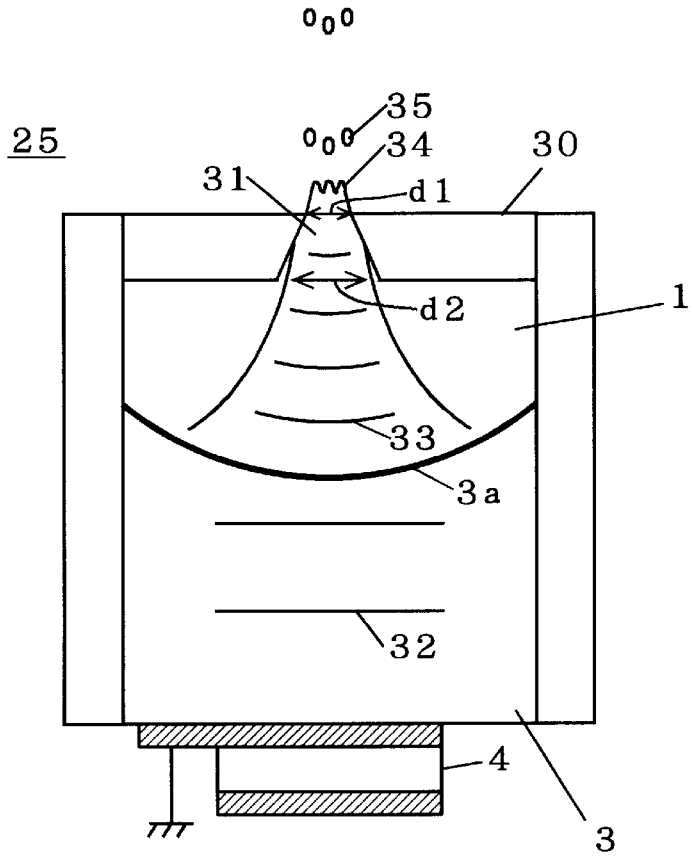
FIG. 2 schematically illustrates ultrasonic waves propagating in the head of FIG. 1.

FIG. 2 is a schematic cross-sectional view of the head of FIG. 1 for illustration of the ultrasonic wave propagating in the head. The vibrator 4 changes its configuration in the direction perpendicular to the bottom surface of the substrate 3 to generate and transmit the ultrasonic wave to the substrate 3. An ultrasonic wave 32 propagating in the substrate 3 accordingly has a wavefront parallel to the bottom surface. The ultrasonic wave propagating in the substrate 3 is refracted at the interface between the substrate 3 and the ink 1. An ultrasonic wave 33 propagating in the ink 1 accordingly has a wavefront parallel to a concave surface 3*a*. The ultrasonic wave propagating in the ink 1 is focused at the opening 31 positioned adjacent the focal point of the concave surface 3*a*.

The opening 31 is circular in plan view and tapered in cross-section so that the diameter d2 thereof which is closer to the substrate 3 is greater than the diameter d1 thereof which is farther from the substrate 3. This configuration is intended to efficiently guide an ultrasonic radiation pressure to the liquid surface in the opening 31 independently of slight variations in focal spot diameter of the ultrasonic wave in the opening 31. The nozzle plate 30 is provided to locate the opening 31 at the liquid surface of the ink 1 and to suppress the vibration of the liquid surface on the periphery of the opening 31. The configuration of the nozzle plate 30 is not limited to the plate-like configuration having only the opening 31 as shown in FIG. 2, and the configuration of the opening 31 is not limited to a circle.

The radiation pressure of the ultrasonic wave 33 which is periodically intensified produces a standing wave at the ink liquid surface in the opening 31. Illustrated herein is the ultrasonic wave which disappears while the vibration is weak, particularly the ultrasonic wave which intermittently reaches the opening 31 in accordance with a predetermined period. However, the present invention is not limited to the ultrasonic wave which completely disappears while the vibration is weak, but the vibration should be of such an intensity as to produce a high-order standing wave. In some cases, the liquid ejector responds rather rapidly in the presence of a slight ultrasonic wave. The predetermined period is shorter than a fundamental vibration period Td for which a fundamental standing wave is produced in the opening 31, and the standing wave generated by the application of the radiation pressure in a cycle having such a period is a high-order standing wave. The fundamental standing wave is a standing wave having one antinode in the opening 31. For example, a second-order standing wave is produced when the predetermined period is about half the fundamental vibration period. In this case, two ink droplets are emitted simultaneously from two antinodes of the standing wave. The predetermined period is preferably about one-tenth the fundamental vibration period Td, and more preferably less than about one-fiftieth the fundamental vibration period Td. For example, a standing wave having antinodes the number of which differs from an intended number of mounds is produced if the predetermined period which is about one-fiftieth the fundamental vibration period Td is slightly deviated. However, a high-order standing wave may be used for printing and the like in spite of a slight difference in the number of antinodes, and a shorter period is advantageous when the high-order standing wave is desired independently of the number of antinodes. A plurality of droplets considered to be emitted simultaneously from the antinodes of the high-order standing wave have a diameter smaller than the diameter d1 of the opening 31. Since the direction of the vibration of the antinodes of the standing wave is orthogonal to the liquid surface, a plurality of particles are emitted from the mounds in the direction orthogonal to the liquid surface. This improves the directivity of the emitted ink.

Figure 3:
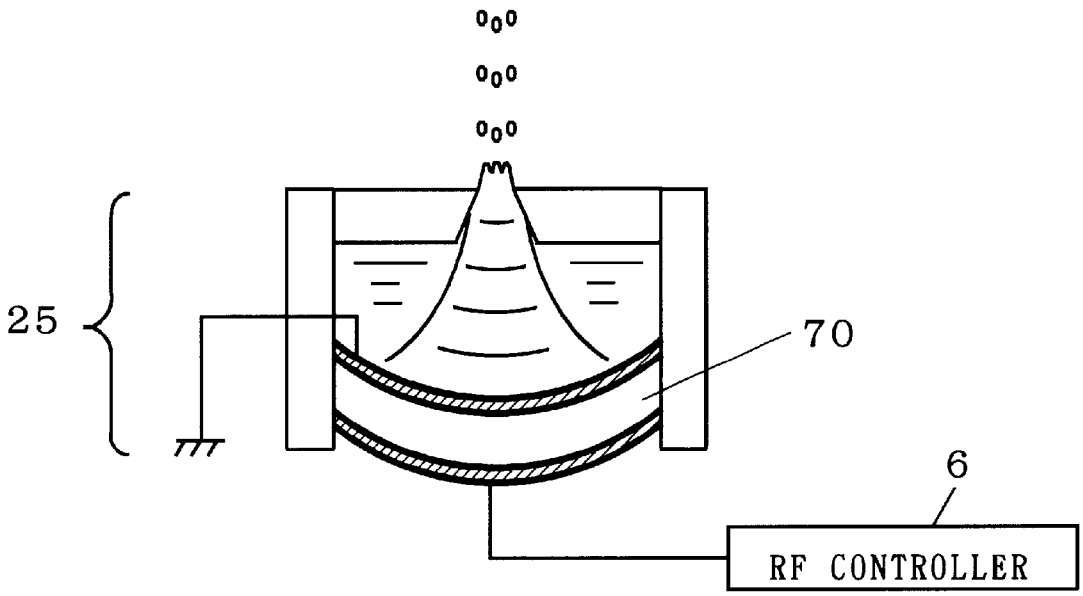
FIG. 3 schematically illustrates a vibrator shell of a concave configuration.

Although the substrate 3 having the concave surface 3*a* contacting the liquid (ink 1) is used herein, the construction of the substrate 3 is not limited to that shown in FIG. 2 as far as the substrate 3 functions to focus the ultrasonic wave being transmitted to the liquid, that is, to focus the ultrasonic wave adjacent the opening 31. For instance, a vibrator shell 70 of a concave configuration as shown in FIG. 3 may be used to constitute the head 25 in place of the means for focusing the ultrasonic wave by means of the acoustic lens.

Thus, the ultrasonic wave applying means for applying the ultrasonic wave to the liquid adjacent the opening 31 comprises the substrate 3, the vibrator 4, and the RF controller 6 in the first preferred embodiment.

FIG. 4A shows an RF signal having a frequency fr equal to the thickness resonant frequency of the vibrator 4. FIG. 4B shows a gate signal having a period T1 shorter than the fundamental vibration period Td of the liquid surface in the opening 31 of the nozzle plate 30, and a pulse width T2. The RF signal of FIG. 4A is AM modulated using the timing of the gate signal FIG. 4B into a burst signal shown in FIG. 4C having the period T1 (<Td) and a time duration T2. For example, the fundamental vibration period T0 of a free liquid surface is 800 $\mu$s and the period Ta is 1 ms in the background art. On the other hand, in the first preferred embodiment, when the fundamental vibration period Td in the opening 31 which is generally shorter than the period Ta is set to 600 $\mu$s, the period T1 is set to 60 $\mu$s, for example. The burst signal vibrates the vibrator 4 to generate a high-order standing wave 34 at the liquid surface in the opening 31. A plurality of droplets 35 are emitted simultaneously from the plurality of mounds of the high-order standing wave.

For stable ink emission, the time duration T2 is preferably not greater than 10% of the period T1. However, it has been experimentally confirmed that a plurality of droplets are simultaneously emitted when the time duration T2 is about 90% of the period T1. For similar reason, the time duration T2 is preferably longer than one cycle of the RF signal.

The period T1 of the burst signal applied to the vibrator 4 may be changed by changing the period T1 of the gate signal.

The results of changes in the period T1 of the burst signal adjacent the opening 31 are described with reference to FIGS. 5A through 5C and FIG. 6. FIG. 5A is a schematic illustration adjacent the opening 31 when a burst frequency, that is, the reciprocal of the period T1 of the burst signal is about 20 KHz. FIG. 5B is a schematic illustration adjacent the opening 31 when the burst frequency is about 55 KHz. FIG. 5C is a schematic illustration adjacent the opening 31 when the burst frequency is about 180 KHz. As the period T1 of the burst signal is decreased, the liquid surface state in the opening 31 changes from the state shown in FIG. 5A to the state shown in FIG. 5C. At a lower varying frequency (the reciprocal of the period T1 of the burst signal) of the ultrasonic radiation pressure applied intermittently to the opening 31, the standing wave has a longer wavelength, and the droplets emitted from the apexes (mounds) of the standing wave have a greater diameter. On the other hand, at a higher varying frequency of the ultrasonic radiation pressure applied intermittently to the opening 31, the standing wave has a shorter wavelength, and the droplets emitted from the mounds of the standing wave have a smaller diameter.

Figure 6:
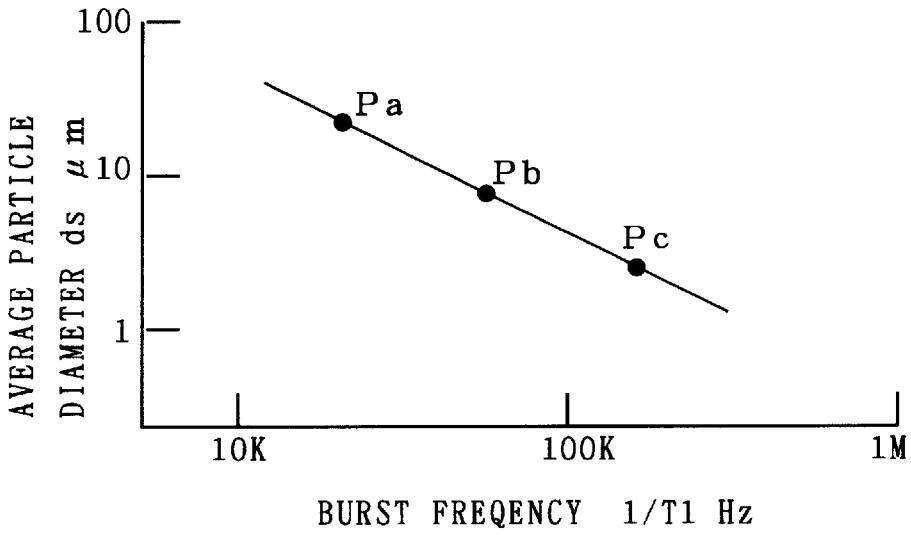
FIG. 6 is a graph showing the relationship between a burst frequency and the average particle diameter of emitted droplets.

FIG. 6 is a graph showing the relationship between the burst frequency and the average particle diameter of the droplets. The points Pa, Pb, and Pc on the graph represent values under the conditions illustrated in FIGS. 5A, 5B, and 5C, respectively. It is understood from the graph of FIG. 6 that the burst frequency and the average particle diameter are in inverse proportion to each other. The time duration T2 of the burst signal in the graph is 4% of the period T1.

In this manner, the droplets of a desired average particle diameter may be provided readily by changing the period T1 of the output (burst signal) from the RF controller without the need to change the diameter of the opening 31 and the frequency fr of the RF signal. This enhances the versatility of the liquid ejector.

A preferred usage of the liquid ejector includes the print head shown in FIG. 19. The use of the liquid ejector of the present invention in place of the background art print head accomplishes high-speed printing. Specifically, the background art print head emits droplets one by one at a time interval which is required to be greater than the fundamental vibration period T0. Further, when some droplets constitute one pixel, the time required for each pixel is many times greater than the fundamental vibration period T0 in the background art print head.

On the other hand, the use of the liquid ejector of the first preferred embodiment which simultaneously emits the plurality of ink droplets having a diameter smaller than the diameter of the opening 31 of the nozzle plate 30 eliminates the need for a particularly costly high-frequency signal source and a nozzle having a small diameter opening to allow the emission of fine ink droplets, accomplishing high-definition printing. Further, the vibration of the antinodes of the standing wave in the direction perpendicular to the ink liquid surface provides a beam of droplets having good directivity to achieve a high resolution. The ink in the form of the plurality of fine droplets deposited on recording paper is difficult to blot on the recording paper. Further, the emission of the droplets at time intervals still shorter than the fundamental vibration period Td of the opening 31 which is shorter than the fundamental vibration period T0 of the free liquid surface increases the speed of printing over the background art printing without degradation of print quality.

Although the diameter of the beam adjacent the opening 31 is greater than the diameter d1 of the opening 31 in the above description, the diameter of the beam may be smaller than the diameter d1 of the opening 31 so far as a high-order standing wave is formed. In this case, effects similar to those of the first preferred embodiment may be produced.

Second Preferred Embodiment

Figure 7:
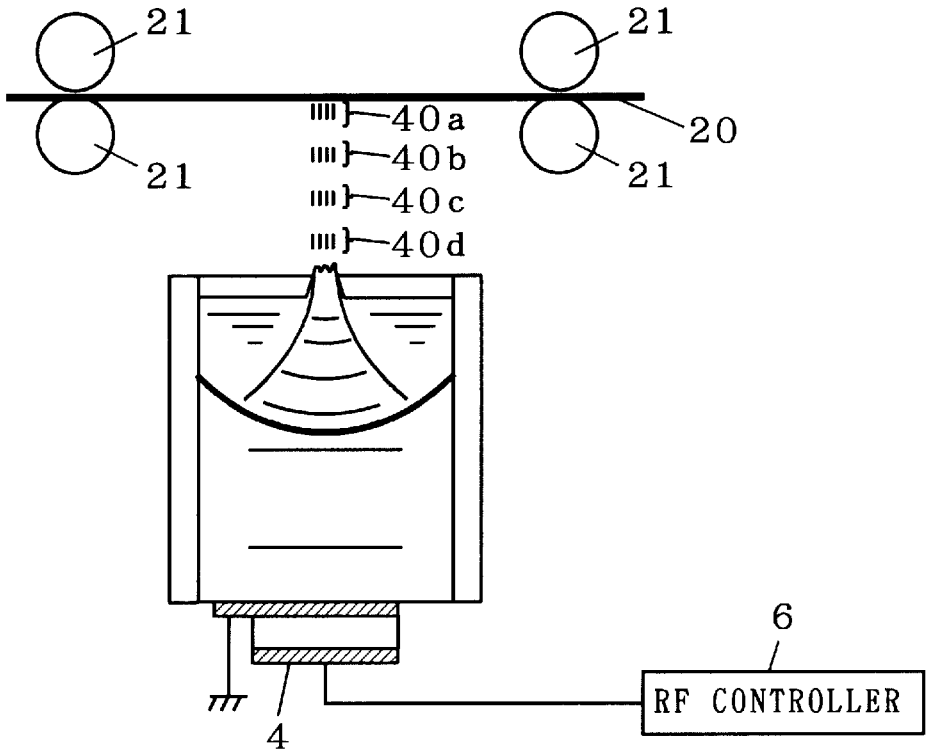
FIG. 7 schematically partially illustrates a printing apparatus according to a second preferred embodiment of the present invention.

FIG. 7 schematically partially illustrates a printing apparatus according to a second preferred embodiment of the present invention. In FIG. 7, reference characters 40*a* to 40*d* designate respective sets of ink droplets, each set of ink droplets being emitted for each time duration T2. Like reference numerals are used in FIG. 7 to designate elements identical with or corresponding to those of FIG. 19.

FIGS. 8A through 8D are timing charts showing the relationship between the drive signal outputted from the RF controller 6 of the printing apparatus and the burst signal for generating the drive signal. FIG. 8A shows the burst signal B generated in the RF controller 6. FIG. 8B shows the burst signal B of FIG. 8A, with a time axis drawn on a reduced scale. The width of the thick lines of FIG. 8B corresponds to the time duration T2. FIG. 8C shows a printing timing signal PT applied to the RF controller 6 and indicative of the printing start timing for one pixel. FIG. 8D shows the drive signal SD outputted from the RF controller 6 to the vibrator 4. The printing timing signal PT has a predetermined pulse period T3. The printing apparatus controls the feed of recording paper 20 so that one pixel is formed for the period T3 of the printing timing signal PT. The longer the sum of the time durations T2 of the burst signal B included in the drive signal SD within the period T3, the more the amount of ink deposited on the recording paper 20. Thus, the number of droplet sets 40*a* to 40*d* for each pixel may be controlled by changing the number Ni of bursts (the number of times the RF signal appears) within the period T3. That is, the amount of ink emitted and deposited in the same position is controlled, and the recording shade for each pixel on the recording paper 20 is accordingly controlled.

FIG. 9 is a block diagram showing an arrangement of the RF controller 6 for producing the drive signal SD. A video signal VD applied to the RF controller 6 is converted by a converter circuit 50 which in turn transmits the number Ni of bursts depending on the darkness indicated by the video signal VD to a gate circuit 51. The gate circuit 51 receives the burst signal B from a burst signal generating circuit 52, and passes the burst signal B therethrough until the number of bursts indicated by the converter circuit 50 is reached. The gate circuit 51 thus generates the drive signal SD to apply the drive signal SD to the vibrator 4.

Figure 10:
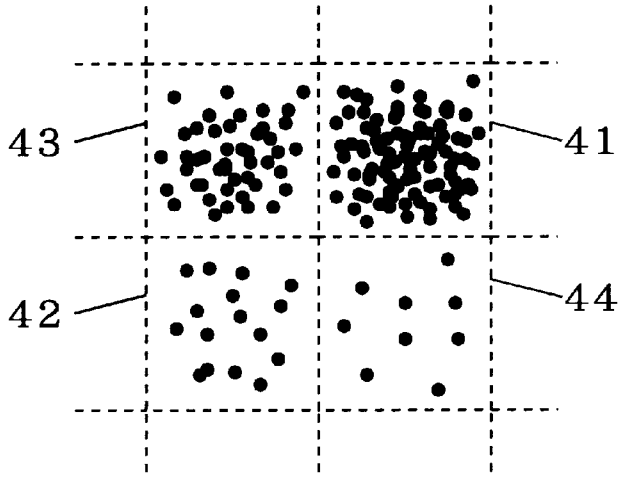
FIG. 10 schematically illustrates four pixels formed using different numbers of bursts.

FIG. 10 schematically illustrates four pixels formed in accordance with the drive signal having a time period (4×T3) shown in FIG. 8D. It is apparent from FIG. 10 that a pixel comprises a group of fine dots formed by a set of ink droplets having a diameter smaller than the size of the single pixel. A pixel 41 associated with the greatest number N1 of bursts per period T3 has the highest density. The pixels 43, 42, and 44 associated with the decreasing numbers N3, N2 and N4 of bursts have decreasing dot densities.

The printing apparatus as above described controls the amount of ink to be emitted by changing the number Ni of bursts of the burst signal B to be applied, to continuously control the recording density for each pixel on the recording paper with a simple circuit arrangement, achieving high-definition printing.

Third Preferred Embodiment

Figure 11:
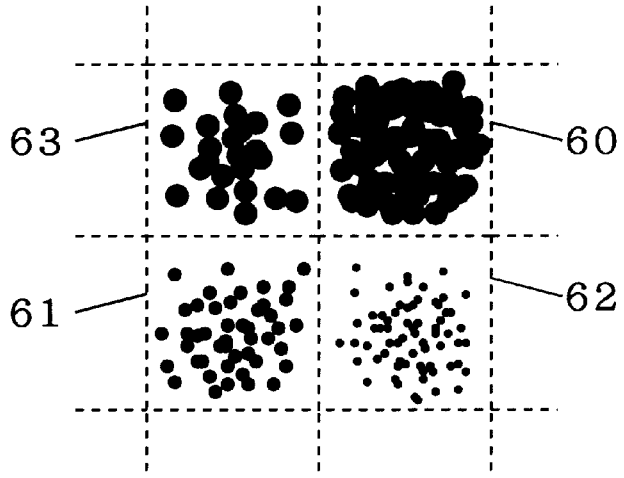
FIG. 11 schematically illustrates pixels formed using different burst signal periods.

The printing apparatus according to a third preferred embodiment of the present invention will be discussed with reference to FIG. 11. Pixels 60 to 62 partitioned by the dotted lines of FIG. 11 are printed by changing the period T1 of the burst signal, with the time duration T2 held equal.

The pixels 60, 61 and 62 are provided in descending order of the period T1 of the burst signal and, accordingly, have the decreasing sizes of the deposited dots.

With reference to FIGS. 4A through 4C, as the period T1 becomes shorter, the diameter of the ink droplets decreases but the number of ink droplets increases. For reasons that are not yet specifically obvious, the shorter the period T1, the smaller the product of the number of ink droplets emitted at a time and the diameter of the ink droplets (that is, the total amount of ink emitted at a time). Hence, the pixel 60 has a relatively high density of the painted area by the ink, whereas the pixel 62 has a relatively low density of the painted area by the ink. The lower the density of the painted area by the ink, the lower a level of darkness for each pixel.

For printing one pixel for a time period several times greater than the period T1, for example, for the period T3 shown in FIGS. 8A through 8D, the period T1 of the burst signal outputted from the RF controller 6 shown in FIG. 1 may be changed to provide high-definition gradation.

The combination of the change in the number Ni of bursts in the second preferred embodiment and the change in the period T1 of the burst signal in the third preferred embodiment allows the recording shade to be controlled in a wider range.

Figure 12:
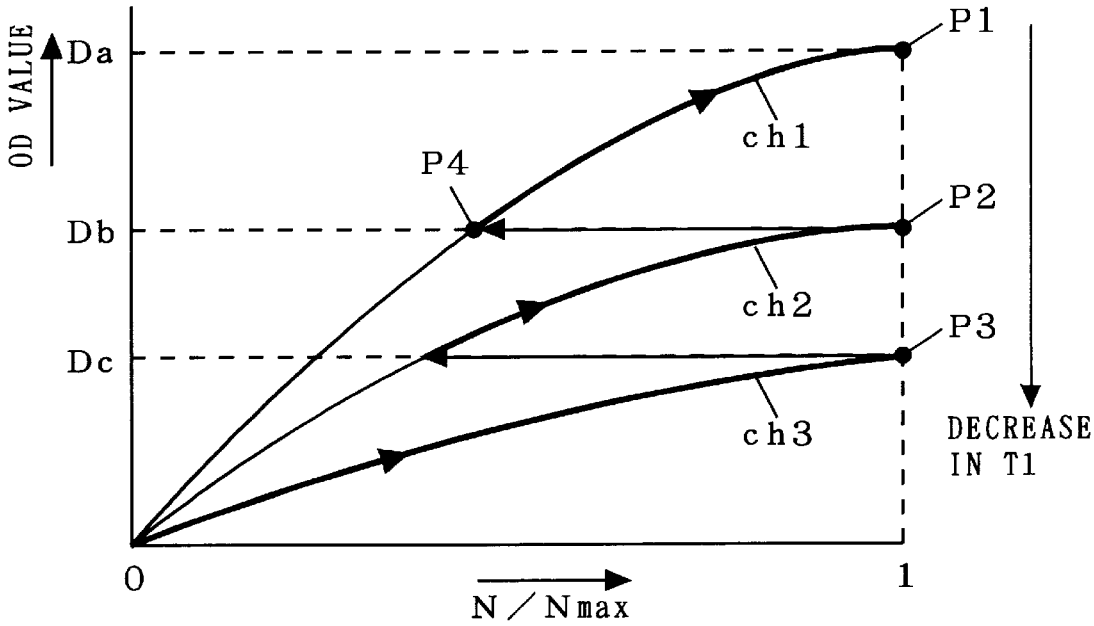
FIG. 12 illustrates an example of the relationship between a recording density and the number of bursts per pixel.

FIG. 12 is a graph showing the relationship between an OD value indicative of the recording shade and the number N of bursts per pixel. A maximum value Nmax of the number N of bursts for the period T3 increases as the period T1 decreases while the period T3 is constant. In FIG. 12, the sum of the time durations T2 is constant since the time durations T2 are fixedly set to 4% of the respective periods T3, for example. Characteristics curves Ch1, Ch2 and Ch3 are provided in descending order of the period T1 of the burst signal.

When the period T1 of the burst signal for the characteristic curve Ch3 is used, a smaller amount of ink is emitted at a time, and the OD value indicative of the recording density is increased up to only a value Dc.

For further increase in recording shade, the period T1 of the burst signal should be made longer so as to provide the characteristic curve Ch2 or Ch1. The shade may be relatively easily changed up to a maximum shade when an OD value Da is set to about 2. For example, the pixels 60 to 63 are printed under the conditions indicated by points P1 to P4 on the graph, respectively.

Fourth Preferred Embodiment

Figure 13:
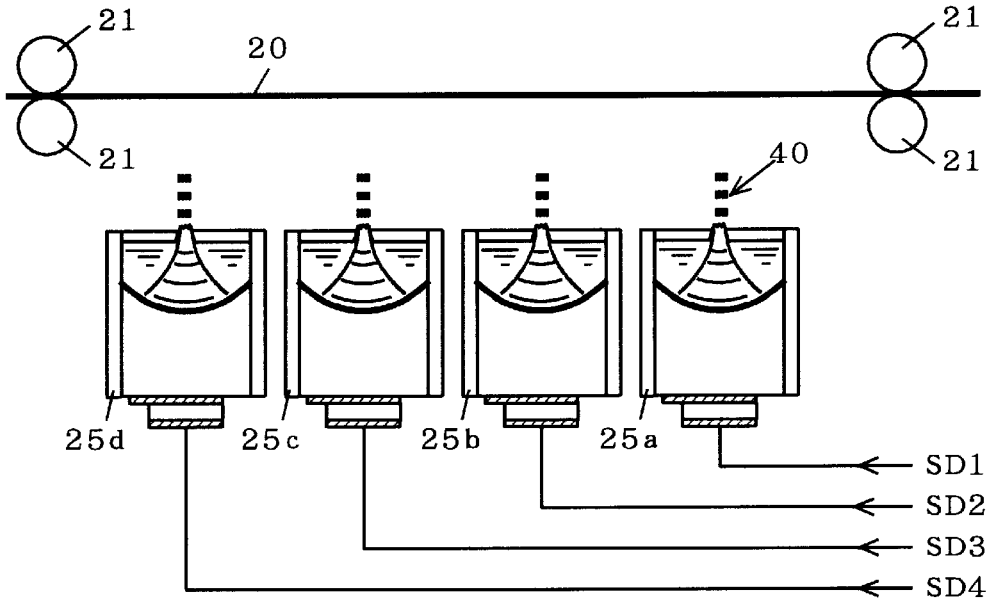
FIG. 13 schematically illustrates a printing apparatus having four heads according to a fourth preferred embodiment of the present invention.

The printing apparatus according to a fourth preferred embodiment of the present invention will be discussed with reference to FIGS. 13 and 14. The printing apparatus shown in FIG. 13 comprises four heads 25*a* to 25*d*. Elements other than feed rollers 21 for feeding the recording paper 20 and the liquid ejector heads 25*a* to 25*d* are not shown in FIG. 13. The heads 25*a* to 25*d* are similar in construction to the head 25 of the liquid ejector shown in FIG. 1.

FIG. 14 shows drive signals SD1 to SD4 to be applied to the heads 25*a* to 25*d*, respectively. The drive signals SD1 to SD4 have the same period T1 but differ in burst generation timing. Thus, the heads 25*a* to 25*d* are not simultaneously driven to reduces the likelihood of degradation of print quality due to interference with each other when mechanically coupled to each other. The provision of the plurality of heads 25*a* to 25*d* may reduce instantaneous power consumption. This reduces a power supply output from the printing apparatus and requires low costs for fabrication of the printing apparatus.

While the invention has been described in detail, the foregoing description is in all aspects illustrative and not restrictive. It is understood that numerous other modifications and variations can be devised without departing from the scope of the invention.

We claim:

1. A liquid ejector for emitting liquid having a liquid surface, comprising:

a nozzle member having an opening defining a fundamental standing wave of the liquid surface with a fundamental vibration; and ultrasonic wave applying means for applying an ultrasonic wave having an intensity which varies in a time period shorter than the fundamental vibration period the liquid surface to generate a high-order standing wave, having a plurality of antinodes, at the liquid surface the opening.

2. The liquid ejector according to claim 1, wherein said ultrasonic wave applying means varies a frequency of the intensity of the ultrasonic wave.

3. The liquid ejector according to claim 1, wherein the intensity of the ultrasonic wave is low when the ultrasonic wave is suspended, and is high when the ultrasonic wave is not suspended.

4. The liquid ejector according to claim 1, wherein the ultrasonic wave has a maximum intensity during a time duration which is not greater than one-tenth the time period.

5. The liquid ejector according to claim 1, wherein the time period is not greater than one-fiftieth the fundamental vibration period.

6. The liquid ejector according to claim 1, wherein the time period is variable.

7. The liquid ejector according to claim 6, wherein said ultrasonic wave applying means varies a frequency of the intensity of the ultrasonic wave.

8. The liquid ejector according to claim 6, wherein said nozzle simultaneously emits a plurality of liquid droplets and said ultrasonic wave applying means increases the number of liquid droplets simultaneously emitted by said nozzle member by decreasing the time period.

9. The liquid ejector according to claim 1, wherein said opening is shaped to form a liquid surface having a circular configuration.

10. The liquid ejector according to claim 1, wherein said opening is tapered so that part of said opening which is closer to the liquid surface is wider.

11. The liquid ejector according to claim 1, wherein the high-order standing wave generated at the liquid surface of said opening has the plurality of antinodes to emit a plurality of liquid droplets in the time period.

12. A printing apparatus comprising:

a liquid ejector for emitting liquid having a liquid surface, including:

a nozzle member having an opening defining a fundamental standing wave of the liquid surface with a fundamental vibration period; and ultrasonic wave applying means for applying an ultrasonic wave having an intensity which varies in a time period shorter than the fundamental vibration period to the liquid surface to generate a high-order standing wave, having a plurality of antinodes, at the liquid surface formed in the opening; and paper feed means for feeding recording paper opposite to said liquid ejector, wherein the liquid emitted from said liquid ejector is deposited on the recording paper fed by said paper feed means to make a print on the recording paper.

13. The printing apparatus according to claim 12, wherein said ultrasonic wave applying means varies a frequency of the intensity of the ultrasonic wave.

14. The printing apparatus according to claim 12, wherein the time period is variable.

15. The printing apparatus according to claim 14, wherein said ultrasonic wave applying means varies a frequency of the intensity of the ultrasonic wave.

16. The printing apparatus according to claim 12, wherein said liquid ejector comprises a plurality of liquid ejectors, and said plurality of liquid ejectors differ from each other in timing of a variation in the intensity of the ultrasonic wave.

17. The printing apparatus according to claim 12, wherein the intensity of the ultrasonic wave is low when the ultrasonic wave is suspended, and is high when the ultrasonic wave is not suspended.

18. The printing apparatus according to claim 12, wherein said opening is shaped to form a liquid surface having a circular configuration.

19. The printing apparatus according to claim 12, wherein said opening is tapered so that part of said opening which is closer to the liquid surface is wider.

20. The printing apparatus according to claim 12, wherein the high-order standing wave generated at the liquid surface of the opening has the plurality of antinodes to emit a plurality of liquid droplets in the time period.

* * * * *